US006163899A

United States Patent [19]

Leonard

[11] Patent Number: 6,163,899

[45] Date of Patent: Dec. 26, 2000

[54] SHOWER CURTAIN APPARATUS

[76] Inventor: Mary-Helen Leonard, 5606 Tremont St., Dallas, Tex. 75214

[21] Appl. No.: 09/364,977

[22] Filed: Jul. 31, 1999

Related U.S. Application Data

[60] Provisional application No. 60/096,707, Aug. 17, 1998.

[51] Int. Cl.[7] ..... A47K 3/08; A47K 3/14

[52] U.S. Cl. ..... 4/558; 47/557; 47/600; 47/607; 47/608; 160/330; 160/DIG. 6

[58] Field of Search ..... 4/555, 557, 558, 4/559, 599, 600, 607, 608, 609, 605; 160/124, 330, DIG. 6, 40, 126, 179, 236

[56] References Cited

U.S. PATENT DOCUMENTS

| | | | |
|---|---|---|---|
| 2,840,155 | 6/1958 | Stern | 4/558 |
| 3,837,145 | 9/1974 | Festner | 160/330 |
| 4,083,395 | 4/1978 | Romano | 160/330 |
| 4,126,172 | 11/1978 | Faragher, Jr. | 160/330 |
| 4,333,187 | 6/1982 | Schuler | 4/608 |
| 5,070,551 | 12/1991 | Harrison et al. | 4/608 |
| 5,191,922 | 3/1993 | Wade | 160/330 |
| 5,271,447 | 12/1993 | Aronovich | 160/236 |
| 5,495,628 | 3/1996 | Logan | 4/558 |
| 5,572,831 | 11/1996 | Rafiqui | 160/236 |
| 5,761,751 | 6/1998 | Morrissey | 4/558 |
| 5,974,603 | 11/1999 | Frazier | 4/558 |

*Primary Examiner*—Henry J. Recla
*Assistant Examiner*—Tuan Nguyen

[57] ABSTRACT

A curtain apparatus includes a flexible pocket assembly which includes a transparent front panel portion, hook reception channels located at a top portion of the flexible pocket assembly, pocket sealing members attached to the flexible pocket assembly for sealing the flexible pocket assembly, and article stabilizer pins attached to the flexible pocket assembly for restraining motion of articles placed in the flexible pocket assembly. An article is retained in the flexible pocket assembly and is connected to the article stabilizer pins. The article is a flat decorative sheet. The flexible pocket assembly includes a flexible transparent first sheet which includes a first top edge, a pair of first side edges, and a first bottom edge. The flexible pocket assembly also includes a flexible second sheet which includes a second top edge, a pair of second side edges, and a second bottom edge. The pair of second side edges are connected to the pair of first side edges with water tight seals, and the second bottom edge is connected to the first bottom edge with a water tight seal. The hook reception channels are located at a top portion of the flexible transparent first sheet and at top portion of the flexible second sheet. The flexible second sheet can also be transparent. The pocket sealing members include a first sealing strip located on the flexible transparent first sheet and a second sealing strip on the flexible second sheet.

11 Claims, 3 Drawing Sheets

SHOWER CURTAIN APPARATUS

CROSS-REFERENCE TO RELATED APPLICATION

This application claims priority based upon my copending Provisional Application Ser. No. 60/096,707, filed Aug. 4, 1998.

BACKGROUND OF THE INVENTION

1. Field of the Invention

The present invention relates generally to curtains and, more particularly, to curtains especially adapted for use in showers.

2. Description of the Prior Art

Shower curtains are well known in the art, and throughout the years, a number of innovations have been developed relating to shower curtains. In this respect, the following U.S. patents are representative of some curtain innovations: U.S. Pat. Nos. 4,083,395, 4126,172, 4,333,187, 5,070,557, and 5,191,922. More specifically, U.S. Pat. No. 4,083,395 discloses an acoustic drape that includes a plurality of individual pockets separated from one another by flexible hinges. The pockets contain sound absorbing foam. For purposes of simplicity, it would be desirable if a shower curtain apparatus were provided in which a single pocket were provided, thereby eliminating the need for plural hinges between plural pockets.

U.S. Pat. No. 4,126,172 discloses a shower curtain which includes two individual curtain portions that are hung on a common curtain rod by separate curtain rings. To avoid the complexities involved with separate curtain portions being hung by separate curtain rings, it would be desirable if a shower curtain apparatus were provided in which plural curtains were hung by a single set of curtain rings.

U.S. Pat. No. 4,333,187 discloses a shower curtain in which a bracket extends upward and inward from the top of the shower curtain to prevent impede moisture from passing over the shower curtain and into the portion of the room not encompassed by the shower curtain. To avoid the complexity of manufacture of a shower curtain having such an inwardly and upwardly projecting bracket, it would be desirable if a shower curtain were provided which does not include a top bracket that extends inwardly and upwardly from the top of the shower curtain.

U.S. Pat. No. 5,070,557 discloses a shower curtain which includes fasteners at the edges of the shower curtain for attaching to complimentary fasteners on the walls of the shower. This shower curtain does not include any pocket for retaining any decorative element. For purposes of esthetics, it would be desirable if a shower curtain were provided that included a pocket for receiving an aesthetically desirable pocket insert.

U.S. Pat. No. 5,191,922 discloses a curtain assembly that includes flap that encircles a curtain support rod and snaps into a locking position once the flap encircles the support rod. Shower curtains conventionally employ curtain rings for hanging a shower curtain on a support rod. The use of curtain rings permits the curtain to be easily moved along the support rod. In this respect, it would be desirable if a shower curtain were provided that employed curtain rings for supporting the shower curtain on a support rod.

Still other features would be desirable in a shower curtain apparatus. For example, when a pocket is used with a shower curtain, to prevent water from entering into the pocket, it would be desirable for the pocket to have sealing structures to seal water out of the pocket.

Shower curtains are often very decorative and have aesthetic appeal. However, often a person tires of a particular decorative design and would like a design change. Rather than replacing an entire shower curtain with another shower curtain with a different decorative design, it would be desirable if a shower curtain were provided that permits changing a decorative design without replacing the shower curtain.

Thus, while the foregoing body of prior art indicates it to be well known to use shower curtains with different features, the prior art described above does not teach or suggest a shower curtain apparatus which has the following combination of desirable features: (1) has a single pocket without having plural hinges between plural pockets; (2) has plural curtain members that are hung by a single set of curtain rings; (3) does not include a top bracket that extends inwardly and upwardly from the top of the shower curtain; (4) includes a pocket for receiving an aesthetically desirable pocket insert; (5) employs curtain rings, not a flap, for supporting the shower curtain on a support rod; (6) has a pocket with sealing structures to seal water out of the pocket; and (7) permits changing a decorative design without replacing the shower curtain. The foregoing desired characteristics are provided by the unique shower curtain apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a curtain apparatus which includes a flexible pocket assembly which includes a transparent front panel portion, hook reception channels located at a top portion of the flexible pocket assembly, pocket sealing means attached to the flexible pocket assembly for sealing the flexible pocket assembly, and article stabilizer means attached to the flexible pocket assembly for restraining motion of articles placed in the flexible pocket assembly. An article is retained in the flexible pocket assembly and is connected to the article stabilizer means. The article is a flat decorative sheet. The article includes pin reception channels.

The flexible pocket assembly includes a flexible transparent first sheet which includes a first top edge, a pair of first side edges, and a first bottom edge. The flexible pocket assembly also includes a flexible second sheet which includes a second top edge, a pair of second side edges, and a second bottom edge. The pair of second side edges are connected to the pair of first side edges with water tight seals, and the second bottom edge is connected to the first bottom edge with a water tight seal.

The hook reception channels are located at a top portion of the flexible transparent first sheet and at top portion of the flexible second sheet. The flexible second sheet can also be transparent.

The pocket sealing means include a first sealing member located on the flexible transparent first sheet and a second sealing member located on the flexible second sheet. The first sealing member and the second sealing member are complementary sealing strips. The article stabilizer means include stabilizer pins which extend through the flexible transparent first sheet, an article, and the flexible second sheet. The flexible transparent first sheet includes first pin reception channels, and the flexible second sheet includes second pin reception channels. Each of the stabilizer pins includes a flat pin head, a pin shaft, and flexible distal pin wings located at a distal end of the pin shaft. Each of the pin wings includes a bulbous wing end. Pin wing reception sockets are attached to the flexible second sheet for receiving pin wings.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shower curtain apparatus which has all of the advantages of the prior art and none of the disadvantages.

It is another object of the present invention to provide a new and improved shower curtain apparatus which may be easily and efficiently manufactured and marketed.

It is a further object of the present invention to provide a new and improved shower curtain apparatus which is of durable and reliable construction.

An even further object of the present invention is to provide a new and improved shower curtain apparatus which is susceptible of a low cost of manufacture with regard to both materials and labor, and which accordingly is then susceptible of low prices of sale to the consuming public, thereby making such shower curtain apparatus available to the buying public.

Still yet a further object of the present invention is to provide a new and improved shower curtain apparatus which has a single pocket without having plural hinges between plural pockets.

Still another object of the present invention is to provide a new and improved shower curtain apparatus that has plural curtain members that are hung by a single set of curtain rings.

Yet another object of the present invention is to provide a new and improved shower curtain apparatus which does not include a top bracket that extends inwardly and upwardly from the top of the shower curtain.

Even another object of the present invention is to provide a new and improved shower curtain apparatus that includes a pocket for receiving an aesthetically desirable pocket insert.

Still a further object of the present invention is to provide a new and improved shower curtain apparatus which employs curtain rings, not a flap, for supporting the shower curtain on a support rod.

Yet another object of the present invention is to provide a new and improved shower curtain apparatus that has a pocket with sealing structures to seal water out of the pocket.

Still another object of the present invention is to provide a new and improved shower curtain apparatus which permits changing a decorative design without replacing the shower curtain.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
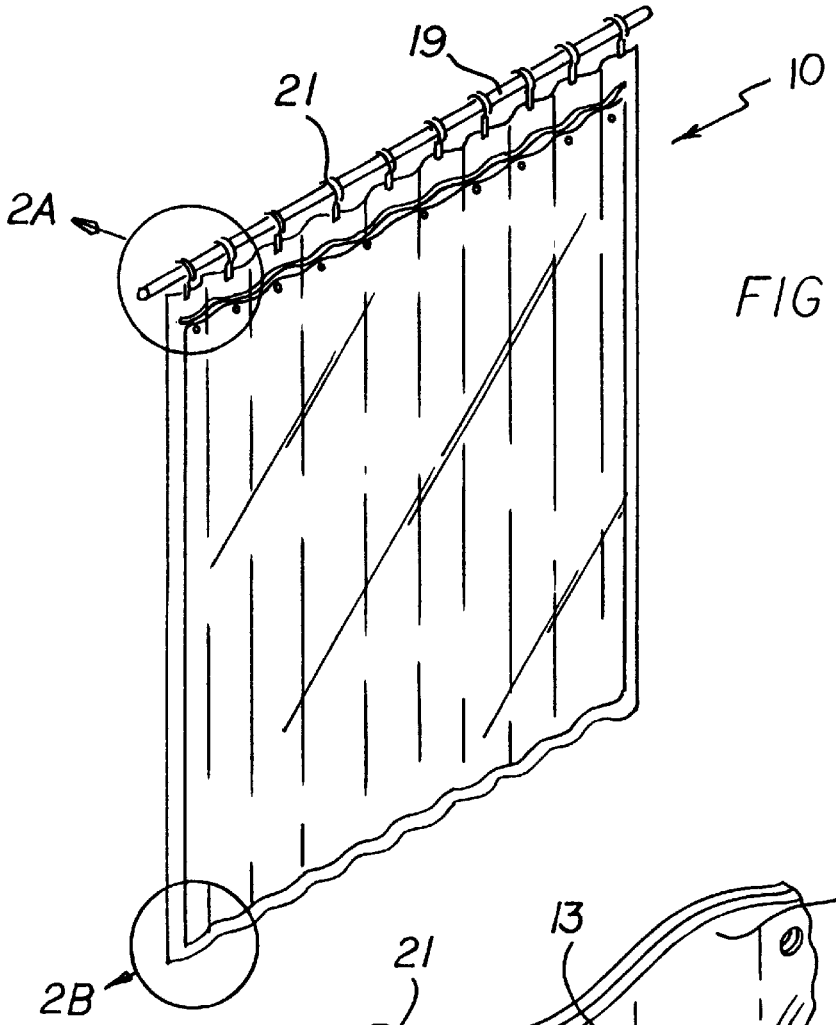
FIG. 1 is a perspective view showing a preferred embodiment of the shower curtain apparatus of the invention suspended from a shower curtain rod.
Figure 2A:
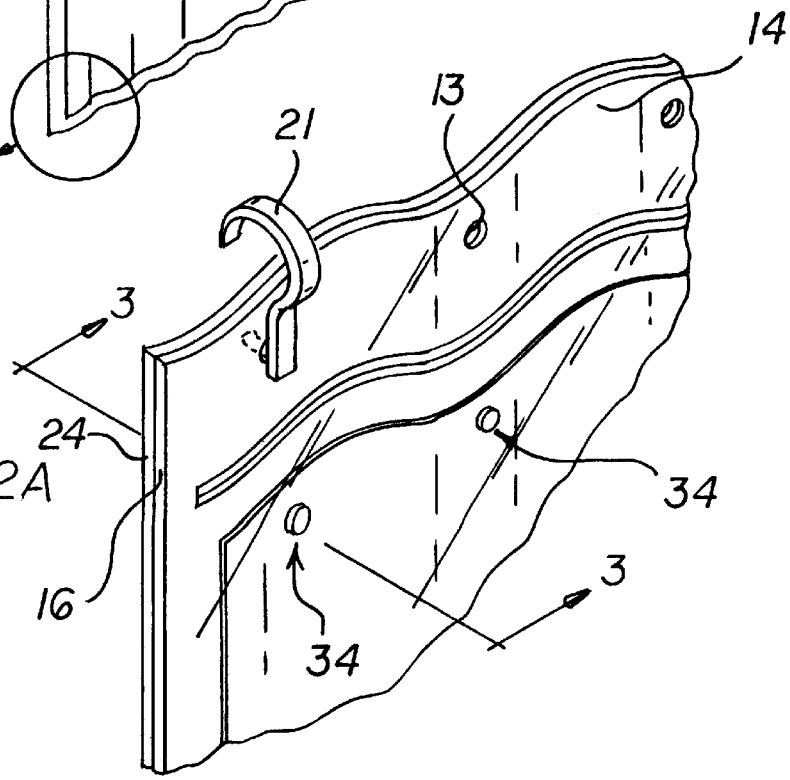
FIG. 2A is an enlarged perspective view of a portion of the embodiment of the shower curtain apparatus shown in circled region 2A of FIG. 1.
Figure 2B:
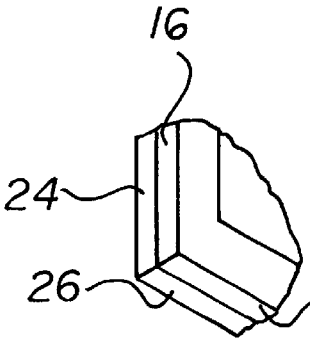
FIG. 2B is an enlarged perspective view of a portion of the embodiment of the shower curtain apparatus shown in circled region 2B of FIG. 1.
Figure 3:
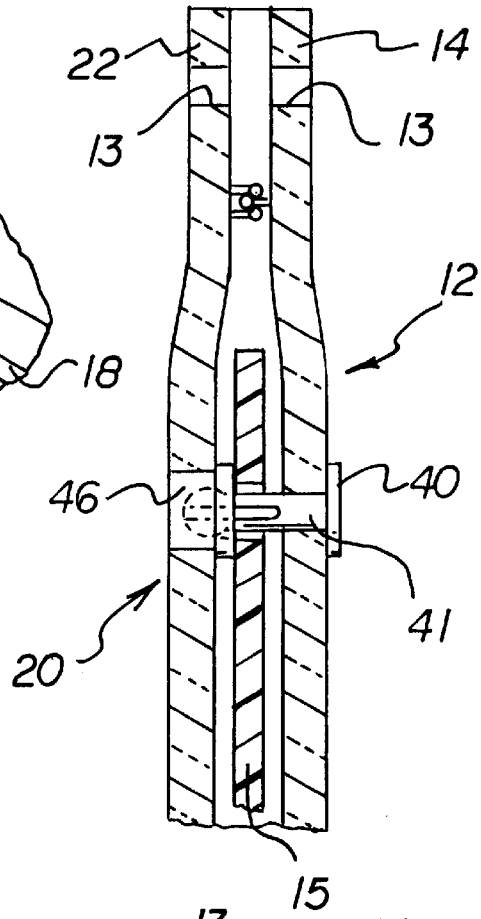
FIG. 3 is an enlarged cross-sectional view of the portion of the embodiment of the shower curtain apparatus of FIG. 2 taken along line 3—3 thereof.

With reference to the drawings, a new and improved shower curtain apparatus embodying the principles and concepts of the present invention will be described.

Turning to FIGS. 1–5, there is shown an exemplary embodiment of the shower curtain apparatus of the invention generally designated by reference numeral 10. In its preferred form, shower curtain apparatus 10 includes a flexible pocket assembly which includes a transparent front panel portion, hook reception channels 13 located at a top portion of the flexible pocket assembly, pocket sealing means attached to the flexible pocket assembly for seeding the flexible pocket assembly, and article stabilizer means attached to the flexible pocket assembly for restraining motion of articles placed in the flexible pocket assembly. An article 15 is retained in the flexible pocket assembly and is connected to the article stabilizer means. The article 15 is a flat decorative sheet 15. The article 15 includes pin reception channels 17.

The flexible pocket assembly includes a flexible transparent first sheet 12 which includes a first top edge 14, a pair of first side edges 16, and a first bottom edge 18. The flexible pocket assembly also includes a flexible second sheet 20 which includes a second top edge 22, a pair of second side edges 24, and a second bottom edge 26. The pair of second side edges 24 are connected to the pair of first side edges 16 with water tight seals, and the second bottom edge 26 is connected to the first bottom edge 18 with a water tight seal.

The hook reception channels 13 are located at a top portion of the flexible transparent first sheet 12 and at top portion of the flexible second sheet 20. The flexible second sheet 20 can also be transparent.

The pocket sealing means include a first sealing member 30 located on the flexible transparent first sheet 12 and a second sealing member 32 located on the flexible second sheet 20. The first sealing member 30 and the second sealing member 32 are complementary sealing strips. The article stabilizer means include stabilizer pins 34 which extend through the flexible transparent first sheet 12, an article, and the flexible second sheet 20. The flexible transparent first sheet 12 includes first pin reception channels 36, and the flexible second sheet 20 includes second pin reception channels 38. Each of the stabilizer pins 34 includes a flat pin head 40, a pin shaft 41, and flexible distal pin wings located at a distal end of the pin shaft 41. Each of the pin wings includes a bulbous wing end 42. Pin wing reception sockets 46 are attached to the flexible second sheet 20 for receiving pin wings.

Figure 4:
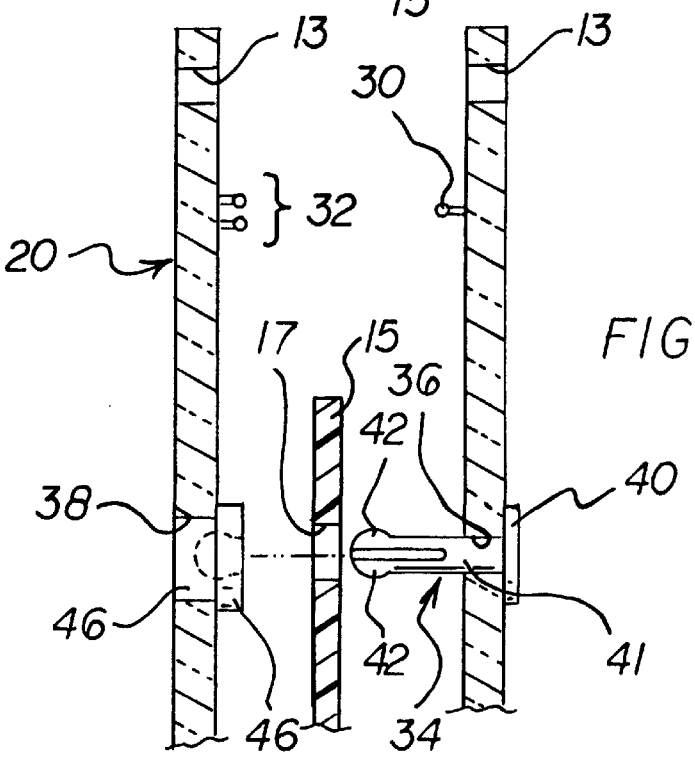
FIG. 4 is an exploded view of the portion of the embodiment of the invention shown in FIG. 3.
Figure 5:
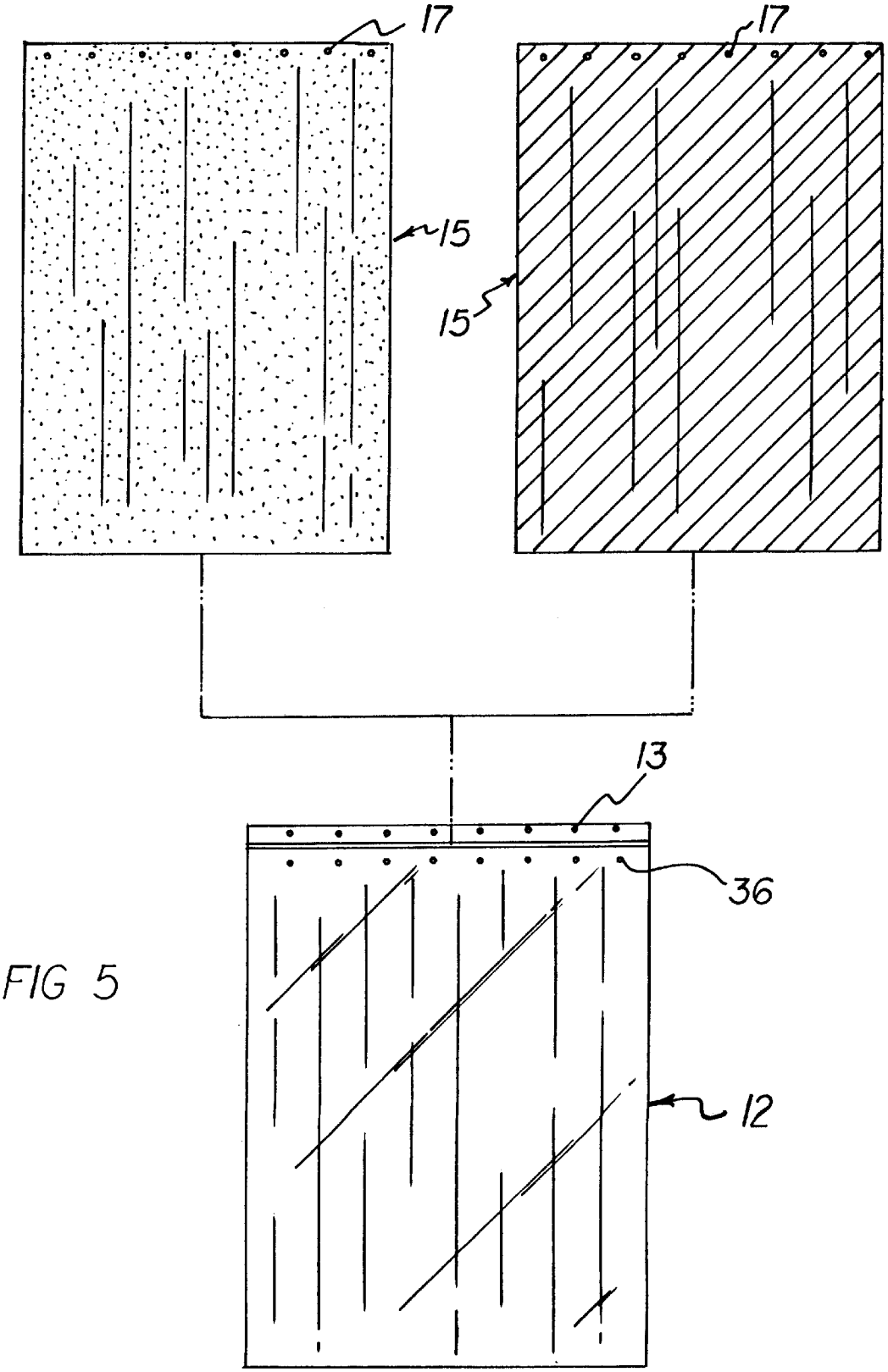
FIG. 5 is a front view of a preferred embodiment of the invention with a number of alternative inserts.

To use the curtain apparatus 10 of the invention, as shown in FIG. 4, the flexible transparent first sheet 12 and the flexible second sheet 20 are separated from one another. Then, a flat article 15 is inserted between the flexible transparent first sheet 12 and the flexible second sheet 20. The article 15 can be a flat decorative sheet 15 which has a visual design or other artistic expression. As shown in FIG. 5, a variety of articles 15 that have different artistic designs can be employed. If desired, the articles 15 that are placed in the apparatus can be made by the consumers themselves. For example, children can use markers to create their own designs. The articles 15 can be easily changed, and, in this respect, the articles can be changed during different holiday seasons to reflect holiday motifs.

Once the selected article 15 is inserted in the flexible pocket assembly, the stabilizer pins 34 are inserted to fix the article 15 in the flexible pocket assembly. More specifically, for each stabilizer pin 34 to be used, a respective first pin reception channel 36, a respective insert pin reception channel 17, and a respective pin wing reception socket 46 are placed in registration, and the pin wings 42 of the stabilizer pin 34 are passed through the registered channels and into the socket. The reception of the pin wings 42 in the respective pin wing reception socket 46 secures the respective stabilizer pin 34 to the apparatus and the article 15 retained in the apparatus.

To prevent water from entering into the interior of the flexible pocket assembly, the first sealing member 30 and the second sealing member 32 are pressed together to provide a water-tight seal for the flexible pocket assembly and the article 15 retained therein.

As shown in FIG. 1, the curtain apparatus 10 is suspended from a shower curtain rod 19 by curtain hooks 21, portions of which are received in hook reception channels 13. Once the curtain apparatus 10 is supported by the shower curtain rod 19, the curtain apparatus 10 can be used in the same way that a conventional shower curtain is used. However, with the invention the articles 15, as shown in FIG. 5 can be interchangeable. To interchange one article 15 with another article 15, the curtain hooks 21 are removed, the first sealing member 30 and the second sealing member 32 are separated, the stabilizer pins 34 are removed, the one article 15 is removed, and the other article 15 is placed within the flexible pocket assembly. Then, the stabilizer pins 34 are replaced, the first sealing member 30 and the second sealing member 32 are resealed, and the curtain hooks 21 are replaced.

The components of the shower curtain apparatus of the invention can be made from inexpensive and durable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved shower curtain apparatus that is low in cost, relatively simple in design and operation, and which may advantageously be used to with a single pocket without having plural hinges between plural pockets. With the invention, a shower curtain apparatus is provided which has plural curtain members that are hung by a single set of curtain rings. With the invention, a shower curtain apparatus is provided which does not include a top bracket that extends inwardly and upwardly from the top of the shower curtain. With the invention, a shower curtain apparatus is provided which includes a pocket for receiving an aesthetically desirable pocket insert. With the invention, a shower curtain apparatus is provided which employs curtain rings, not a flap, for supporting the shower curtain on a support rod. With the invention, a shower curtain apparatus is provided which has a pocket with sealing structures to seal water out of the pocket. With the invention, a shower curtain apparatus is provided which permits changing a decorative design without replacing the shower curtain.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A curtain apparatus, comprising:

a flexible pocket assembly which includes a transparent front panel portion, hook reception channels located at a top portion of said flexible pocket assembly, pocket sealing means attached to said flexible pocket assembly for sealing said flexible pocket assembly, article stabilizer means attached to said flexible pocket assembly for restraining motion of articles placed in said flexible pocket assembly, an article retained in said flexible pocket assembly and connected to said article stabilizer means, wherein said article includes pin reception channels, wherein said flexible pocket assembly includes:

a flexible transparent first sheet which includes a first top edge, a pair of first side edges, and a first bottom edge, and a flexible second sheet which includes a second top edge, a pair of second side edges, and a second bottom edge, wherein said pair of second side edges are connected to said pair of first side edges, and wherein said second bottom edge is connected to said first bottom edge, and wherein said pocket sealing means is horizontally disposed between said hook reception channels and said article stabilizer means.

2. The apparatus of claim 1 wherein said article is a flat decorative sheet.

3. The apparatus of claim 1 wherein said hook reception channels are located at a top portion of said flexible transparent first sheet and at top portion of said flexible second sheet.

4. The apparatus of claim 1 wherein said flexible second sheet is transparent.

5. The apparatus of claim 1 wherein said pocket sealing means include:

a first sealing member located on said flexible transparent first sheet, and a second sealing member located on said flexible second sheet.

6. The apparatus of claim 5 wherein said first sealing member and said second sealing member are complementary sealing strips.

7. A curtain apparatus, comprising:

a flexible pocket assembly which includes a transparent front panel portion, hook reception channels located at a top portion of said flexible pocket assembly, pocket sealing means attached to said flexible pocket assembly for sealing said flexible pocket assembly, and article stabilizer means attached to said flexible pocket assembly for restraining motion of articles placed in said flexible pocket assembly, wherein said flexible pocket assembly includes:

a flexible transparent first sheet which includes a first top edge, a pair of first side edges, and a first bottom edge, and a flexible second sheet which includes a second top edge, a pair of second side edges, and a second bottom edge, wherein said pair of second side edges are connected to said pair of first side edges, and wherein said second bottom edge is connected to said first bottom edge to form waterproof edges, and wherein said article stabilizer means include:

stabilizer pins which extend through said flexible transparent first sheet, an article, and said flexible second sheet.

8. The apparatus of claim 7 wherein:

said flexible transparent first sheet includes first pin reception channels, said flexible second sheet includes second pin reception channels.

9. The apparatus of claim 7 wherein each of said stabilizer pins includes:

a flat pin head, a pin shaft, flexible distal pin wings located at a distal end of said pin shaft.

10. The apparatus of claim 9 wherein each of said pin wings includes a bulbous wing end.

11. The apparatus of claim 10, further including:

pin wing reception sockets attached to said flexible second sheet for receiving pin wings.

* * * * *